US008720164B2

(12) United States Patent
Buchhauser et al.

(10) Patent No.: US 8,720,164 B2
(45) Date of Patent: May 13, 2014

(54) CLOSING APPARATUS FOR CONTAINERS

(71) Applicant: Krones AG, Neutraubling (DE)

(72) Inventors: Klaus Buchhauser, Deuerling (DE); Guenter Frankenberger, Koefering (DE)

(73) Assignee: Krones AG (DE)

( * ) Notice: Subject to any disclaimer, the term of this patent is extended or adjusted under 35 U.S.C. 154(b) by 0 days.

(21) Appl. No.: 13/735,662

(22) Filed: Jan. 7, 2013

(65) Prior Publication Data

US 2013/0133287 A1 May 30, 2013

Related U.S. Application Data

(62) Division of application No. 12/613,407, filed on Nov. 5, 2009, now Pat. No. 8,375,684.

(30) Foreign Application Priority Data

Nov. 6, 2008 (DE) ..... 10 2008 056 241

(51) Int. Cl.
*B65B 7/28* (2006.01)

(52) U.S. Cl.
USPC ..... 53/329; 53/490; 53/510; 53/432; 53/485; 53/317; 53/334; 53/284.6

(58) Field of Classification Search
USPC ..... 53/490, 510, 432, 485, 329, 317, 334, 53/284.6
See application file for complete search history.

(56) References Cited

U.S. PATENT DOCUMENTS

| | | | | |
|---|---|---|---|---|
| 2,423,358 | A | 7/1947 | Hohl et al. | 53/432 |
| 2,931,147 | A | 4/1960 | Barnby | 53/432 |
| 4,240,242 | A | 12/1980 | Sullivan et al. | 53/471 |
| 4,909,014 | A | 3/1990 | Kobayashi et al. | 53/86 |
| 5,178,304 | A | 1/1993 | Torterotot | 222/333 |
| 5,309,955 | A | 5/1994 | Torterotot | 141/1 |
| 5,464,595 | A | 11/1995 | Finnah | 422/297 |
| 5,528,879 | A | 6/1996 | Louy et al. | 53/201 |
| 5,653,091 | A | 8/1997 | Stark | 53/426 |

(Continued)

FOREIGN PATENT DOCUMENTS

| | | | |
|---|---|---|---|
| CN | 1891614 | 1/2007 | B67B 3/00 |
| CN | 101152951 | 4/2008 | B67B 3/20 |

(Continued)

OTHER PUBLICATIONS

European Search Report dated Jul. 7, 2010.

(Continued)

*Primary Examiner* — Christopher Harmon
(74) *Attorney, Agent, or Firm* — Hayes Soloway P.C.

(57) ABSTRACT

An apparatus for closing containers includes a movable closing head for applying closures to the containers and is arranged in the interior of a sterile chamber of the apparatus and arranged to move in a longitudinal direction (L) of the containers to be closed. At least one wall is provided which delimits the sterile chamber, wherein the closing device is arranged on a carrier which is arranged partially inside the sterile chamber and partially outside the sterile chamber, and extends through the wall and moves in the longitudinal direction (L) relative to the wall. Arranged in the interior of the sterile chamber is a first sealing element which is elastic in the longitudinal direction (L) and which seals off from the sterile chamber a region of the outer periphery of the carrier.

21 Claims, 2 Drawing Sheets

(56) References Cited

U.S. PATENT DOCUMENTS

| | | | | |
|---|---|---|---|---|
| 5,848,515 | A | 12/1998 | Catelli et al. | 53/167 |
| 6,082,418 | A | 7/2000 | Naecker et al. | 141/145 |
| 6,230,472 | B1 | 5/2001 | Stahlecker | 53/426 |
| 6,474,368 | B2 | 11/2002 | Clusserath et al. | 141/6 |
| 6,684,603 | B2 | 2/2004 | Nervo | 53/167 |
| 7,121,062 | B2 | 10/2006 | Till | 53/167 |
| 7,341,079 | B2 | 3/2008 | Zanga | 141/92 |
| 7,536,839 | B2 | 5/2009 | Kemper et al. | 53/426 |
| 8,006,464 | B2 | 8/2011 | Krulitsch | 53/253 |
| 2007/0006550 | A1 | 1/2007 | Kemper et al. | 53/426 |
| 2008/0078144 | A1 | 4/2008 | Cirio | 53/359 |
| 2009/0151814 | A1 | 6/2009 | Kelly et al. | 141/286 |
| 2011/0072762 | A1 | 3/2011 | Jakob | 53/285 |

FOREIGN PATENT DOCUMENTS

| | | | |
|---|---|---|---|
| DE | 690 00 233 | 11/1990 | B65B 3/32 |
| DE | 42 26 797 | 2/1994 | B65B 55/06 |
| DE | 198 06 520 | 8/1999 | B65B 55/18 |
| DE | 20 2006 003 975 | 8/2007 | B67B 3/20 |
| EP | 0 758 624 | 2/1997 | B67C 7/00 |
| EP | 1 262 445 | 12/2002 | B67B 3/20 |
| EP | 1 905 728 | 4/2008 | B67B 3/20 |

OTHER PUBLICATIONS

Chinese Office Action, Appln. No. 2009102122159, dated Aug. 3, 2012 (9 pgs).

CLOSING APPARATUS FOR CONTAINERS

CROSS REFERENCE TO RELATED APPLICATION

This application is a divisional of U.S. application Ser. No. 12/613,407, filed Nov. 5, 2009, which is entirely incorporated herein by reference.

BACKGROUND OF THE INVENTION

The present invention relates to an apparatus for closing containers. Such apparatuses have long been known from the prior art. In production facilities for producing beverage containers, it is customary to fill these containers with a beverage and then to close said containers with a closure, such as a screw cap or else a crown cap for example.

In many sectors there are special conditions, for example when bottling juices. For instance, it is necessary for the entire treatment of the containers and also the closing thereof to be carried out within a sterile chamber or clean chamber. For the closing process, in some cases a longitudinal movement of a closing head relative to a longitudinal direction of the containers is also necessary. Since it is usually not desirable to place all the elements necessary for such a longitudinal movement in the interior of the sterile chamber, since this runs counter to keeping it sterile, endeavours are made to place as many drive elements as possible outside the sterile chamber. However, due to the stroke conditions of the closing element which are necessary in a closing machine, the situation occurs whereby the unsterile machine parts located outside the sterile chamber or below a carrying ring protrude into the sterile area or move into the sterile chamber. In this way, germs can reach the sterile area.

The prior art discloses various apparatuses for achieving a separation between sterile and unsterile areas even in the case of elements which can move in this way. For instance, in some cases a water lock or a vapour barrier is provided in order to bring about such sealing. However, due to the large stroke and the thermal loading of the component, these sealing means can be used only to a limited extent or are difficult to implement. The object of the present invention is therefore to provide an apparatus for closing containers which is also able to cope with relatively large stroke movements.

SUMMARY OF THE INVENTION

An apparatus according to the invention for closing containers comprises a closing device which applies closures to the containers, wherein this closing device comprises a movable closing head for applying the closures to the containers and is arranged in the interior of a sterile chamber of the apparatus and can move in a longitudinal direction of the containers to be closed, wherein at least one wall is provided which delimits the sterile chamber. According to the invention, the closing device is arranged on a carrier which is arranged partially inside the sterile chamber and partially outside the sterile chamber and which moves in the longitudinal direction relative to the sterile chamber or relative to at least one wall of this sterile chamber, wherein arranged in the interior of the sterile chamber is a first sealing element which is elastic in the longitudinal direction and which seals off from the sterile chamber a region of the outer periphery of the carrier.

Preferably this is a region which in a working mode is located partially inside and partially outside the sterile chamber. Preferably the carrier extends through a wall delimiting the sterile chamber.

Preferably this sealing element is elastic in such a way that, in a fully stretched state in the longitudinal direction, it is at least twice as long as in a fully compressed state, preferably at least three times as long and preferably at least four times as long. In this way, sealing can be provided even in the case of considerable stroke movements. A wall is understood to mean an element made from a solid material which is suitable for isolating two gas volumes from one another.

Hereinbelow, a closing device will be understood to mean any device by means of which closures, in particular screw caps can be fitted on or to containers. A sterile chamber will be understood to mean a chamber inside which sterile conditions prevail compared to the external environment. For example, this sterile chamber may be filled with sterile air. The carrier is a component on which the closing device is arranged preferably in a fixed position, and which in the event of a movement brings about a movement of this closing device. This carrier preferably executes a stroke movement, which the closing device follows. A portion of the carrier, which may be configured for example as a rod-shaped body, protrudes into the clean chamber and also out of the latter. More specifically, this rod-shaped body extends through said wall.

Preferably, a guide bushing is provided which extends through the wall and which guides any movement of the carrier relative to the wall.

A sealing element which extends in the longitudinal direction is thus understood to mean an elastic sealing element which seals off from the sterile chamber the outer periphery of the carrier, essentially regardless of the position of the carrier relative to the wall.

In one preferred embodiment, a volume which depends on or varies as a function of a position of the carrier in the longitudinal direction is formed between the sealing element and the outer periphery of the carrier, and this volume is in flow connection with a geometric chamber arranged outside the sterile chamber. This volume is larger or smaller depending on a position of the carrier relative to the wall or the sterile chamber. If, for example, the largest possible volume of the carrier is arranged inside the sterile chamber, preferably said volume is also at a maximum.

A chamber arranged outside the sterile chamber is understood here to mean a chamber which is arranged at least partially outside the sterile chamber. This chamber may also be sealed off in the interior. For instance, it is possible to arrange a further bellows outside the sterile chamber and to supply the volume thereof in turn by the volume of the first bellows. In this way it is possible for the sealing element to "breathe" during the movement of the carrier.

Preferably, the volume arranged outside the sterile chamber is in permanent flow connection with the volume formed between the carrier and the first sealing element. However, it would also be possible for an outlet for the volume between the bellows and the carrier to be arranged outside and preferably below the sterile chamber, or for a boundary to be arranged between the sterile chamber and the unsterile chamber.

In a further advantageous embodiment, said region of the outer periphery of the carrier or part thereof in a working mode of the apparatus is at times inside the sterile chamber and at times outside the sterile chamber. The boundary of the sterile chamber is preferably understood here to mean a geometric plane of extension of said wall. Through this procedure it is possible that, by virtue of the sealing means, the parts (which are unsterile) located for example below a bottle mouth do not move directly into the sterile area above a bottle mouth but rather are covered by the bellows when they are located geometrically inside the clean chamber.

In a further advantageous embodiment, the sealing element is a bellows which extends around the outer periphery. This bellows can be arranged with its lower end on the wall or else on a bushing arranged fixedly in this wall. With its upper end, the bellows can be connected fixedly and preferably also in an airtight manner to the carrier or to a region of the carrier which is permanently located in the sterile chamber.

In a further advantageous embodiment, the closing device comprises a rotatable closing head for screwing closures onto the containers. In this embodiment, the apparatus relates in particular to closing machines which apply screw caps to containers. In this case, preferably this closing head is arranged always in the interior of the sterile chamber.

In a further advantageous embodiment, a drive device for driving the closing head is arranged outside the sterile chamber. This is favourable since such drive devices, such as electric motors, are always a source of risk for sterile chambers.

With particular preference, the apparatus comprises an output wheel which is driven by the drive device and which drives a drive wheel that is connected in rotation with the closing head, wherein teeth at least of the drive wheel and/or of the output wheel extend in the longitudinal direction of the container. In this case, the length of these teeth of one of these wheels in the longitudinal direction is at least twice as large, preferably at least three times as large, as the length of the teeth of the respective other (toothed) wheel.

Preferably, both the output wheel and the drive wheel are arranged in the interior of the sterile chamber. However, the output wheel and the drive wheel may also be wheels with a smooth surface, such as hard rubber wheels for example. In this embodiment, one of the wheels has a longitudinal toothing which extends along the predefined portion of the stroke movement. In this case it is possible, regardless of the stroke position of the closing head, to keep the respective other wheel in engagement with this wheel and thus to allow it to be driven by the latter.

In a further advantageous embodiment, the apparatus comprises a transport device which transports the containers inside the sterile chamber. This device may be for example a transport device which guides the containers at their necks through the sterile chamber. Preferably it may comprise transport starwheels.

In a further advantageous embodiment, arranged in the interior of the sterile chamber is a guide device which guides a movement of the closing head in the longitudinal direction L of the containers. This guide device is preferably arranged entirely in the interior of the sterile chamber.

In a further advantageous embodiment, the apparatus comprises a second sealing element which is elastic in the longitudinal direction and which is arranged at least at times and preferably permanently outside the sterile chamber. Preferably this second elastic sealing element is also a bellows. This bellows may be arranged for example on the lower part of the wall or on the abovementioned guide sleeve, and at the other side also on the carrier. For instance, it is possible that the two bellows or the interiors of these bellows are in flow connection with one another or communicate with one another during a movement of the carrier. In this way, the two bellows can reciprocally "breathe".

Preferably, a volume formed between the first sealing element and the carrier in a first position of the carrier is essentially equal to the volume formed between the second sealing element and the carrier in a second position of the carrier. Preferably these are the respective end positions of the carrier relative to the wall, so that a movement of the carrier relative to the wall can be carried out without any pressure rises. In this case, it would be possible for example that the carriers comprise a central bore which brings about the flow connection between the two bellows.

In a further advantageous embodiment, the movement of the carrier is controlled by a guide cam which is arranged outside the sterile chamber. Preferably, the sterile chamber is arranged between the guide cam and the drive device. In this case, it is possible for example that the rotational movement of a closing head is driven from above and the stroke movement of the carrier is controlled from below.

Preferably, a gas pressure in the interior of the sterile chamber is always higher than outside the sterile chamber, so that no non-sterile gases can enter the interior of the sterile chamber.

If the connecting space of the two sealing elements is connected to the unsterile area by means of a side channel and if the gas pressure in the sterile chamber is higher than in the side channel, progressive damage to the sealing element is in the short term not critical with regard to the sterility since, due to the overpressure, sterile air will escape from the sterile area rather than unsterile air passing from the enclosed space between the sealing elements into the sterile area. If a defined vacuum is applied to the side channel, the integrity of the sealing elements can be checked by means of pressure monitoring.

The present invention also relates to an apparatus for closing containers, in particular of the type described above. This apparatus comprises a closing device which applies closures to the containers, wherein this closing device comprises a movable closing head for applying closures to the containers and is arranged in the interior of a sterile chamber of the apparatus. The apparatus also comprises a drive device for driving the closing head, wherein this drive device is arranged outside the sterile chamber.

According to the invention, the apparatus comprises a rotatable output shaft driven by the drive device in order to drive the closing head, wherein this output shaft extends through a boundary wall of the sterile chamber. A housing is also provided which surrounds this output shaft in some sections in its circumferential direction, wherein furthermore a channel is provided in order to suck a medium, particularly a gaseous medium, out of the housing. The channel is preferably a suction channel for sucking out the medium. The housing surrounds the output shaft preferably in a region which extends through the boundary wall.

BRIEF DESCRIPTION OF THE DRAWINGS

Further advantages and embodiments will emerge from the appended drawings.

In the drawings.

DETAILED DESCRIPTION OF THE INVENTION

Figure 1:
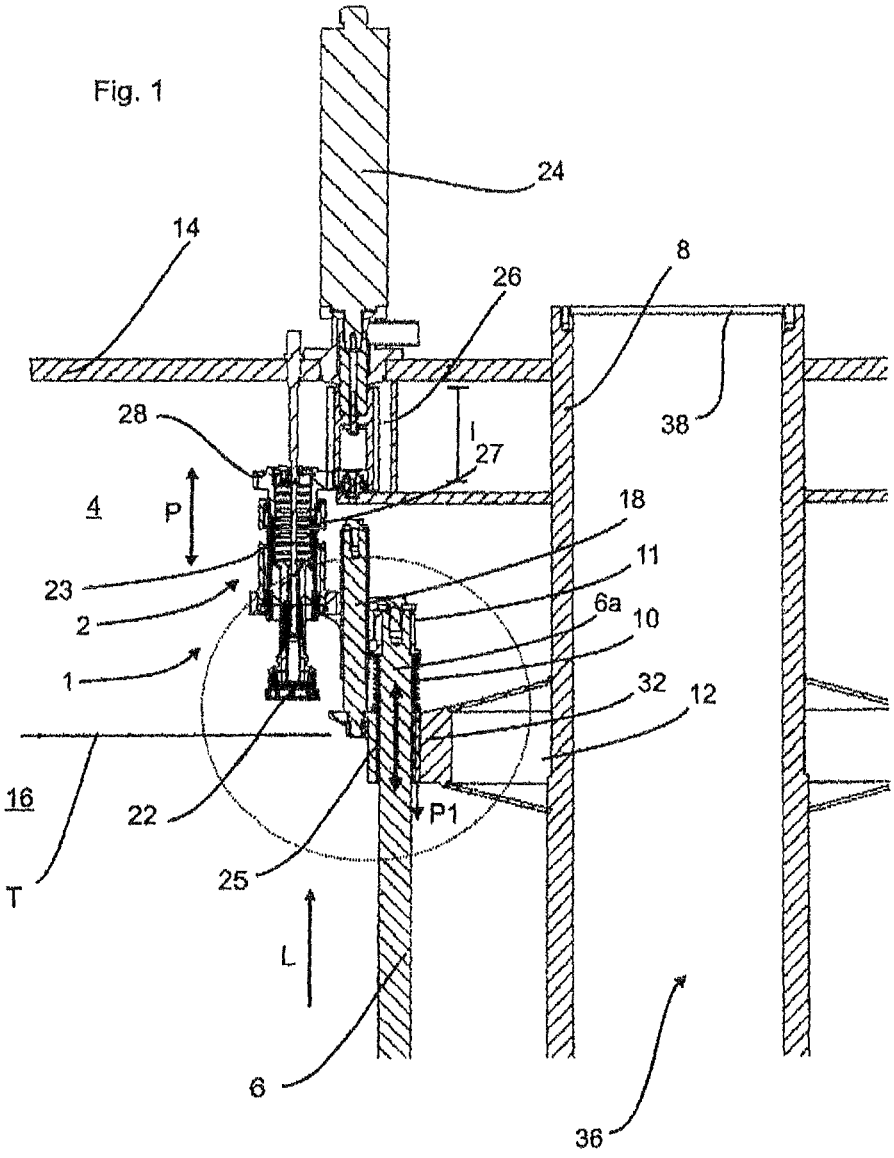
FIG. 1 shows a partial view of an apparatus according to the invention for closing containers.

FIG. 1 shows a partial view of an apparatus 1 according to the invention for closing containers (not shown). This apparatus 1 comprises a closing device, denoted in its entirety by 2, which applies closures to the containers.

Preferably this is a closing device which screws the closures onto the containers. The closing device 2 is movable along the double arrow P or along a longitudinal direction of the containers.

The closing device 2 is arranged entirely inside a sterile chamber or clean chamber 4. The closing device 2 comprises a closing head 22 which is arranged in a rotatable manner. For this purpose, the closing device 2 comprises a carrier 23, within which the closing head 22 is rotatably mounted. In order to rotate the closing head 22, the closing device comprises a toothed drive wheel 28 which is in turn driven by an output wheel 26.

This drive wheel 28 and the output wheel 26 are also located entirely inside the clean chamber 4. The output wheel 26 is driven by a drive device 24, such as an electric motor, wherein this drive device 24 is arranged outside the clean chamber 4. Closures are supplied to the closing device 2 by a supply device (not shown). Reference 27 denotes a spring device which biases the closing head in the direction of the containers (not shown). These containers can be moved towards the closing head 22 by means of a transport device (not shown), such as a transport starwheel.

The drive wheel 28 is displaceable in the longitudinal direction L relative to the output wheel 26, without coming out of engagement with this output wheel. Preferably, the drive wheel 28 is movable relative to the output wheel along the entire stroke of the closing device 2, which can be achieved due to the fact that one of the two wheels 26, 28 has a much larger length l in the longitudinal direction L than the other wheel 28, 26. Preferably, the length of one of the two wheels 26, 28, and in this case of the output wheel 28, is at least as large as the stroke of the closing device 2.

Reference 14 denotes an upper boundary of the sterile chamber. It is possible that the apparatus according to the invention comprises a plurality of drive devices and closing devices 2. In particular, a plurality of closing devices can be arranged on a rotatable shaft 36. An outer circumference 8 of this shaft 36 can in this case also form a boundary wall of the sterile chamber 4. The shaft 36 itself can be sealed off in a sterile manner by a cover 38.

Reference 18 denotes a guide device which is stationary in the longitudinal direction L and which guides a movement of the closing device 2 along the double arrow P. This guide device 18 is preferably also arranged entirely inside the clean chamber 4. The output wheel 26 is configured here as an elongate toothed wheel which extends along the region l, i.e. the individual teeth of this output wheel 26 likewise have the illustrated length l.

The closing device 2 is arranged fixedly on a carrier 6, wherein this carrier is arranged both in the interior of the clean chamber 4 and outside the clean chamber 4, i.e. in a surrounding area 18. Reference 12 denotes a lower wall, by means of which the clean chamber 4 is also delimited and through which the carrier 6 extends.

Reference 10 denotes a sealing means, such as a bellows, which in FIG. 1 is arranged at least at times entirely inside the sterile chamber 4, said sealing means likewise being elastic or stretchable in the direction L. The region 6*a* of the carrier 6 which is arranged at times inside and also at times outside the clean chamber is completely covered by this bellows 10. Furthermore, the carrier is guided by means of a guide bushing 25, or the movement of the carrier 6 is borne thereby. Above this bellows, however, at any point in time there is arranged inside the sterile chamber 4 a connection 11, on which in turn the closing device 2 is fixedly arranged. Here, the bellows is arranged entirely inside the sterile chamber 4.

In the event of a movement of the carrier 6 relative to the wall 12, the bellows 10 is compressed or expanded. In the process, the volume between the bellows and the outer periphery of the carrier 6 changes. For this purpose, a ventilation slit 32 is provided in the guide bushing 25, so that the change in volume along the arrow 21 which takes place during the movement of the carrier 6 can be conducted out of the apparatus and into the non-sterile area 16. By virtue of the apparatus according to the invention, it is possible to prevent germs from entering the sterile chamber 4 and in particular to prevent the unsterile machine parts arranged below the wall or the carrying ring 12 from contaminating the sterile chamber 4.

Reference T marks a line of separation between a sterile area arranged above this line T and an unsterile area arranged below this line T. The mouths of the containers to be closed are essentially arranged at the level of this line of separation T during the working mode.

Figure 2:
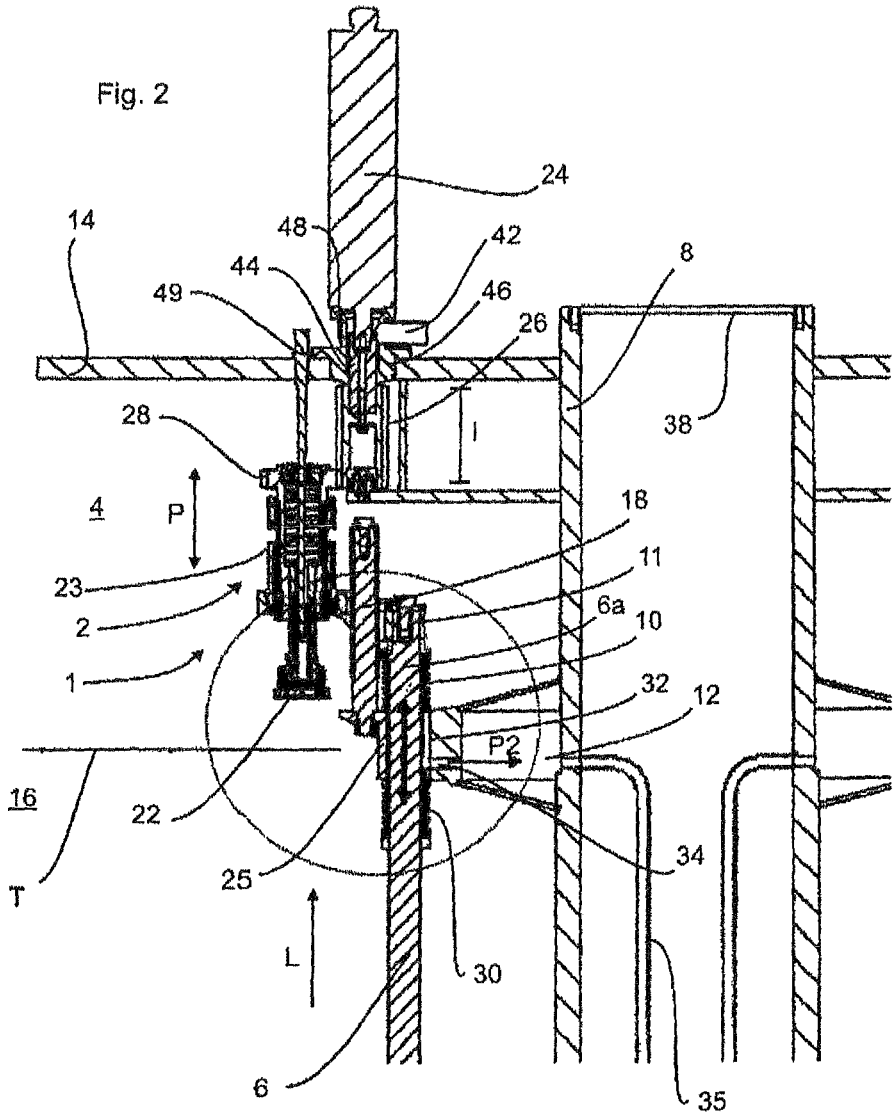
FIG. 2 shows a further embodiment of an apparatus according to the invention for closing containers.

FIG. 2 shows a further embodiment of an apparatus 1 according to the invention. The embodiment shown in FIG. 2 differs from the embodiment shown in FIG. 1 by the fact that the air produced is conducted away through a side channel 34 (arrow P2), into which in turn the ventilation slit 32 opens. This side channel is arranged outside the sleeve 25. Reference 35 denotes a further channel for discharging the air, this channel adjoining the side channel 34.

However, it would also be possible here to connect via the channel 32 only the spaces between the first bellows 10 and the carrier 6 on the one hand and the second bellows 30 and the carrier 6 on the other hand, since a back and forth movement simultaneously causes one bellows to be compressed and the other to be expanded in the same way, so that air is ultimately pushed back and forth between the two bellows. In this case, it would even be possible to omit the ventilation bore 34.

By virtue of the variant shown in FIG. 2 with the two bellows 10, 30, it is possible that the part located inside the bellows need not be cleaned, since there is no connection to the sterile chamber 4. As mentioned, ventilation takes place via the bore 34 out of the clean chamber. Also in the embodiment shown in FIG. 2, therefore, the outer periphery of the carrier or of the region 6*a* is sealed off from the sterile chamber 4.

Reference 42 denotes a channel and in particular a suction channel which is arranged in a region of an output shaft 44 that transmits the rotational movement of the drive device 24 to the output wheel 26. Via this suction channel 42, a gaseous medium and in particular a hydrogen peroxide gas/air mixture can be sucked off directly at the output shaft or motor shaft 44. In this case it is possible that the apparatus comprises a housing or a cylindrical body 46, within which the output shaft 44 runs or within which this output shaft 44 rotates. Here too, therefore, the rotational movement for the closing head 22 is generated outside the clean chamber and is transmitted through the carrier plate to the closing heads 22 located in the clean chamber. In this case the channel extends into the housing 46.

Provided around the output shaft 44 is a small annular gap 48, preferably with a splash protection lip. This annular gap prevents a direct jet onto the drive device 24. The annular gap is adjoined by the channel 42. Penetrating liquid runs off again in the downward direction. Furthermore, during cleaning, any inflowing aerosols can if necessary be sucked off via the suction channel 42. The housing may be formed in one piece with the boundary wall of the sterile chamber, but preferably the housing is inserted in the boundary wall of the sterile chamber. In this case, this housing 46 extends through the boundary wall 14. The housing 46 may have a collar 49, which is supported against the boundary wall 14.

During continuous production, active suction can preferably be omitted since, due to an overpressure in the sterile chamber, a constant overflowing towards the outside takes place. Particularly in the case of $H_2O_2$ installations, suction had to be carried out in the past during sterilisation, since otherwise the MAK values for $H_2O_2$ might have been exceeded in the operator area. This embodiment also offers the advantage that there is no need for abrading seals, vapour barriers or fluid locks.

The special requirements in terms of leaktightness, chemical resistance, etc. of the electrical components and of the housings thereof are also omitted here, since these are located outside the clean chamber. Reliability and the need for maintenance are considerably improved, and moreover a replacement of faulty drive units is possible without opening the clean chamber.

All of the features disclosed in the application documents are claimed as essential to the invention in so far as they are novel individually or in combination with respect to the prior art.

The invention claimed is:

1. An apparatus for closing containers, comprising a closing device which applies closures to the containers, wherein the closing device comprises a movable closing head for applying closures to the containers, which is arranged entirely within the interior of a sterile chamber of the apparatus, and wherein the closing head is rotatable movable for screwing closures onto the containers and is also movable in a longitudinal direction of the containers to be closed, said closing device further comprises a drive device for rotatably driving the closing head, arranged outside the sterile chamber, wherein the apparatus comprises a rotatable output shaft driven by the drive device to drive the closing head, wherein the output shaft extends through a boundary wall of the sterile chamber and a housing is provided which surrounds the output shaft, and wherein a channel is provided to conduct a medium out of the housing, and, further comprising an output wheel which is driven by the drive device and which drives a drive wheel that is connected in rotation with the closing head, wherein teeth at least of the drive wheel and/or of the output wheel extend in a longitudinal direction of the container.

2. The apparatus according to claim 1, wherein the medium comprises a gaseous medium.

3. The apparatus according to claim 1, wherein the closing device is arranged on a carrier, and a volume which depends on a position of the carrier in the longitudinal direction is formed between a first sealing element and an outer periphery of the carrier, which volume is in flow connection with a chamber arranged geometrically outside the sterile chamber.

4. The apparatus according to claim 3, wherein a region of the outer periphery of the carrier in a working mode of the apparatus is at times inside the sterile chamber and at times outside the sterile chamber.

5. The apparatus according to claim 3, wherein the first sealing element is a bellows which extends around the outer periphery of the carrier.

6. The apparatus according to claim 1, wherein the housing surrounds the output shaft in a region which extends through a boundary wall of the sterile chamber.

7. The apparatus according to claim 1, wherein the apparatus comprises a transport device for transporting the containers inside the sterile chamber.

8. The apparatus according to claim 1, wherein arranged in the interior of the sterile chamber is a guide device for guiding movement of the closing head in a longitudinal direction.

9. The apparatus according to claim 3, wherein the apparatus comprises a second sealing element which is elastic in a longitudinal direction and which is arranged at least at times outside the sterile chamber.

10. The apparatus according to claim 9, wherein the second elastic sealing element is a bellows.

11. The apparatus according to claim 9, wherein a volume formed between the first sealing element and the carrier in a first position of the carrier corresponds essentially to a volume formed between the second sealing element and the carrier in a second position of the carrier.

12. The apparatus according to claim 11, wherein the movement of the carrier is controlled by a guide cam which is arranged outside the sterile chamber.

13. The apparatus according to claim 12, wherein the sterile chamber is arranged between the guide cam and the drive device.

14. The apparatus according to claim 1, wherein the drive device is an electric motor.

15. The apparatus according to claim 1, wherein a length of the teeth of one of the two wheels in the longitudinal direction is at least twice as large as a length of the teeth of the respective other toothed wheel.

16. The apparatus according to claim 1, wherein both the output wheel and the drive wheel are arranged in the interior of the sterile chamber.

17. The apparatus according to claim 7, wherein the transport device comprises a starwheel.

18. The apparatus according to claim 8, wherein the guide device is entirely arranged in the interior of the sterile chamber.

19. The apparatus according to claim 1, wherein the channel is a suction channel for sucking medium out of the housing.

20. The apparatus according to claim 1, wherein an annular gap is provided around the output shaft.

21. The apparatus according to claim 20, wherein the annular gap is adjoined by a suction channel.

* * * * *

UNITED STATES PATENT AND TRADEMARK OFFICE

CERTIFICATE OF CORRECTION

PATENT NO. : 8,720,164 B2
APPLICATION NO. : 13/735662
DATED : May 13, 2014
INVENTOR(S) : Buchhauser et al.

It is certified that error appears in the above-identified patent and that said Letters Patent is hereby corrected as shown below:

In the Claims

Claim 12, Col. 8, line 24, “claim 11” should be --claim 1--.

Signed and Sealed this
Fourteenth Day of July, 2015

Michelle K. Lee

Michelle K. Lee
*Director of the United States Patent and Trademark Office*